US008678561B2

(12) United States Patent
Hara et al.

(10) Patent No.: US 8,678,561 B2
(45) Date of Patent: Mar. 25, 2014

(54) LIQUID DISCHARGING HEAD AND METHOD FOR PRODUCING THE SAME

(75) Inventors: Koichiro Hara, Nagoya (JP); Kazuo Kobayashi, Kakamigahara (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 206 days.

(21) Appl. No.: 13/231,216

(22) Filed: Sep. 13, 2011

(65) Prior Publication Data

US 2012/0081475 A1 Apr. 5, 2012

(30) Foreign Application Priority Data

Sep. 30, 2010 (JP) ..... 2010-220598

(51) Int. Cl.
*B41J 2/045* (2006.01)

(52) U.S. Cl.
USPC ..... 347/68; 347/70; 347/71

(58) Field of Classification Search
USPC ..... 347/68–72; 29/25.35, 890.1
See application file for complete search history.

(56) References Cited

U.S. PATENT DOCUMENTS

| | | | | |
|---|---|---|---|---|
| 6,109,737 | A | 8/2000 | Kishima | |
| 2002/0105562 | A1 * | 8/2002 | Miyagawa et al. | 347/56 |
| 2009/0244211 | A1 | 10/2009 | Morita | |
| 2009/0309939 | A1 | 12/2009 | Hirosawa | |

FOREIGN PATENT DOCUMENTS

| | | | |
|---|---|---|---|
| JP | 2002-331671 | * 11/2002 | B41J 2/16 |
| JP | 2003-136705 | 5/2003 | |
| JP | 2005-041053 | 2/2005 | |
| JP | 2005-125798 | 5/2005 | |
| JP | 2009-149026 | * 7/2009 | B41J 2/16 |
| JP | 2009-208223 | 9/2009 | |
| JP | 2009-234143 | 10/2009 | |
| JP | 2010-023486 | 2/2010 | |

OTHER PUBLICATIONS

Notice of Reasons for Rejection for Japanese Patent Application No. 2010-220598 dated Feb. 26, 2013.
Notice of Decision of Refusal for Japanese Patent Application No. 2010-220598 dated Sep. 3, 2013.

* cited by examiner

*Primary Examiner* — Henok Legesse
(74) *Attorney, Agent, or Firm* — Frommer Lawrence & Haug LLP

(57) ABSTRACT

There is provided a liquid discharging head discharging a liquid, including: a channel unit having a liquid channel including a pressure chamber which has an opening at one surface of the channel unit; a piezoelectric element formed of a piezoelectric material; an intermediate member preventing the liquid in the pressure chamber and the piezoelectric element from making contact with each other; a first adhesive layer composed of a first adhesive and adhering the channel unit and the intermediate member, the first adhesive being a thermo-setting adhesive starting to be cured at a first temperature; and a second adhesive layer composed of a second adhesive and adhering the intermediate member and the piezoelectric element, the second adhesive starting to be cured at a second temperature lower than the first temperature.

21 Claims, 7 Drawing Sheets

LIQUID DISCHARGING HEAD AND METHOD FOR PRODUCING THE SAME

CROSS REFERENCE TO RELATED APPLICATION

The present application claims priority from Japanese Patent Application No. 2010-220598 filed on Sep. 30, 2010 the disclosure of which is incorporated herein by reference in its entirety.

BACKGROUND OF THE INVENTION

1. Field of the Invention

The present invention relates to a liquid discharging head provided on a liquid discharging apparatus such as an ink-jet recording apparatus which records a text and an image, and a method for producing the liquid discharging head.

2. Description of the Related Art

As an example of the liquid discharging apparatus, there is known an ink-jet recording apparatus which discharges an ink toward a recording medium to record a text, an image, etc. on the recording medium. The ink-jet recording apparatus includes an ink-jet recording head which is constructed by stacking an ink channel member having an inner space storing the ink and a piezoelectric element deformable with application of voltage. An adhesive used for adhering the channel member and the piezoelectric element with each other is required to have an ink resistance property so that the adhesive force (adhesive strength) of the adhesive does not lower even when the adhesive makes contact with the ink. From this viewpoint, conventionally, a thermo-setting adhesive (thermo-curable adhesive) containing an epoxy resin as a main agent is used in many cases. In the ink-jet recording head, the piezoelectric element is deformed to pressurize the inner space in which the ink is stored, thereby causing the ink to be discharged.

The adhesion by means of the thermo-setting adhesive is performed at a temperature higher than a curing temperature of the thermo-setting adhesive. Here, since the channel member has a thermal expansion coefficient greater than that of the piezoelectric element, the channel member is thermally expanded to an extent greater than the piezoelectric element under a high-temperature environment. In this state, the channel member and the piezoelectric element are adhered to each other with the thermo-curable adhesive. Afterwards, when the temperatures of the channel member and the piezoelectric element adhered to each other return each to a normal or room temperature, the channel member is contracted by a contraction amount greater than a contraction amount by which the piezoelectric element is contracted. Since the channel member and the piezoelectric element are adhered to each other, the piezoelectric element receives a reaction force as the channel member is contracted by the greater contraction amount. Namely, compressive stress is applied to the piezoelectric element when the temperature returns to the room temperature after the adhesion performed under the high temperature, which thus creates a state that after the adhesion, the stress applied to the piezoelectric element during the compression remains in the piezoelectric element. Since the remaining stress hinders the deformation of the piezoelectric element, the piezoelectric property of the piezoelectric element is consequently lowered.

Relating to this problem, Japanese Patent Application laid-open No. 2005-41053 describes that a low-thermal expansion material is used for the channel member, and that the difference between the thermal expansion coefficient of the channel member and the thermal expansion coefficient of the piezoelectric element is reduced to thereby lower the remaining stress generated in the piezoelectric actuator.

SUMMARY OF THE INVENTION

In this case, however, the low-thermal expansion material has to be used as the channel member, and thus has a problem such that a range for selecting the material of channel member is restricted.

In view of the above situation, the inventor of the present application considered using an adhesive which is cured at room temperature (cold-setting adhesive or room-temperature setting adhesive), as another solution to the problem. With this kind of adhesive, there is no need to apply high temperature during the adhesion of the channel member and the piezoelectric element for the purpose of curing. Therefore, there is no problem which would have otherwise caused due to the difference in thermal expansion coefficient between the channel member and the piezoelectric element.

However, unlike the thermo-setting adhesive, a curing agent is generally added to the room-temperature setting adhesive which is cured at the room temperature, so that the room-temperature setting adhesive is cured at a low temperature. In such a case, if the ink makes contact with the room-temperature setting adhesive, a component of the curing agent contained in the adhesive elutes into the ink, which newly causes another problem.

An object of the present teaching is to solve the above-described problem, and to provide an ink-jet recording head with high reliability, and to provide a method for producing such an ink-jet recording head.

According to a first aspect of the present teaching, there is provided a liquid discharging head which discharges a liquid, including: a channel unit in which a liquid channel and a pressure chamber are formed, the pressure chamber having an opening formed at one surface of the channel unit; a piezoelectric element which is formed of a piezoelectric material, and which changes a volume of the pressure chamber; an intermediate member which is adhered to the one surface of the channel unit to cover the opening of the pressure chamber, and which is arranged between the channel unit and the piezoelectric element to prevent the liquid in the pressure chamber and the piezoelectric element from making contact with each other; a first adhesive layer which is composed of a first adhesive and which adheres the channel unit and the intermediate member, the first adhesive being a thermo-setting adhesive which starts to be cured at a first temperature; and a second adhesive layer which is composed of a second adhesive and which adheres the intermediate member and the piezoelectric element, the second adhesive starting to be cured at a second temperature lower than the first temperature.

According to the first aspect of the present teaching, since the second adhesive is used to adhere the piezoelectric element and the intermediate member, the piezoelectric element and the intermediate member are adhered to each other at a lower temperature as compared with a case that a thermo-setting adhesive is used.

Therefore, it is possible to decrease the thermal expansion of the piezoelectric element and the thermal expansion of the intermediate element as compared with a case of using the thermo-setting adhesive. Accordingly, the compressive stress applied to the piezoelectric element after the adhesion can be made small, thereby making it possible to suppress the lowering of the piezoelectric property.

Further, since the first adhesive which is the thermo-setting adhesive is used to adhere the channel unit and the intermediate member with each other, a component contained in the first adhesive hardly elutes into a liquid in the pressure chamber even when the liquid in the pressure chamber and the first adhesive contact with each other.

According to a second aspect of the present teaching, there is provided a method for producing a liquid discharging head which discharges a liquid, the method including:

a step of preparing a channel unit having a liquid channel formed in the channel unit and including a pressure chamber which has an opening at one surface of the channel unit; a piezoelectric element which is formed of a piezoelectric material, and which changes a volume of the pressure chamber; and an intermediate member which is to be adhered to the one surface of the channel unit to cover the opening of the pressure chamber, and which is to be arranged between the channel unit and the piezoelectric element to prevent the liquid in the pressure chamber and the piezoelectric element from making contact with each other;

a first adhering step of adhering the channel unit and the intermediate member with a first adhesive which is a thermo-setting adhesive; and a second adhering step of adhering the intermediate member and the piezoelectric element with a second adhesive which is cured at a temperature lower than a temperature at which the first adhesive is cured.

According to the second aspect of the present teaching, since the second adhesive is used to adhere the piezoelectric element and the intermediate member, the piezoelectric element and the intermediate member can be adhered to each other at a lower temperature as compared with a case that a thermo-setting adhesive is used.

Therefore, it is possible to decrease the thermal expansion of the piezoelectric element and the thermal expansion of the intermediate member (separation member) than in a case of using the thermo-setting adhesive. Accordingly, the compressive stress applied to the piezoelectric element after the adhesion can be made small, thereby making it possible to suppress the lowering of the piezoelectric property.

Further, since the first adhesive which is the thermo-setting adhesive is used for adhesion of the channel unit with the intermediate member, a component contained in the first adhesive hardly elutes into a liquid in the pressure chamber even when the liquid in the pressure chamber makes contact with the first adhesive.

DESCRIPTION OF THE PREFERRED EMBODIMENTS

<Ink-Jet Recording Apparatus>

Figure 1:
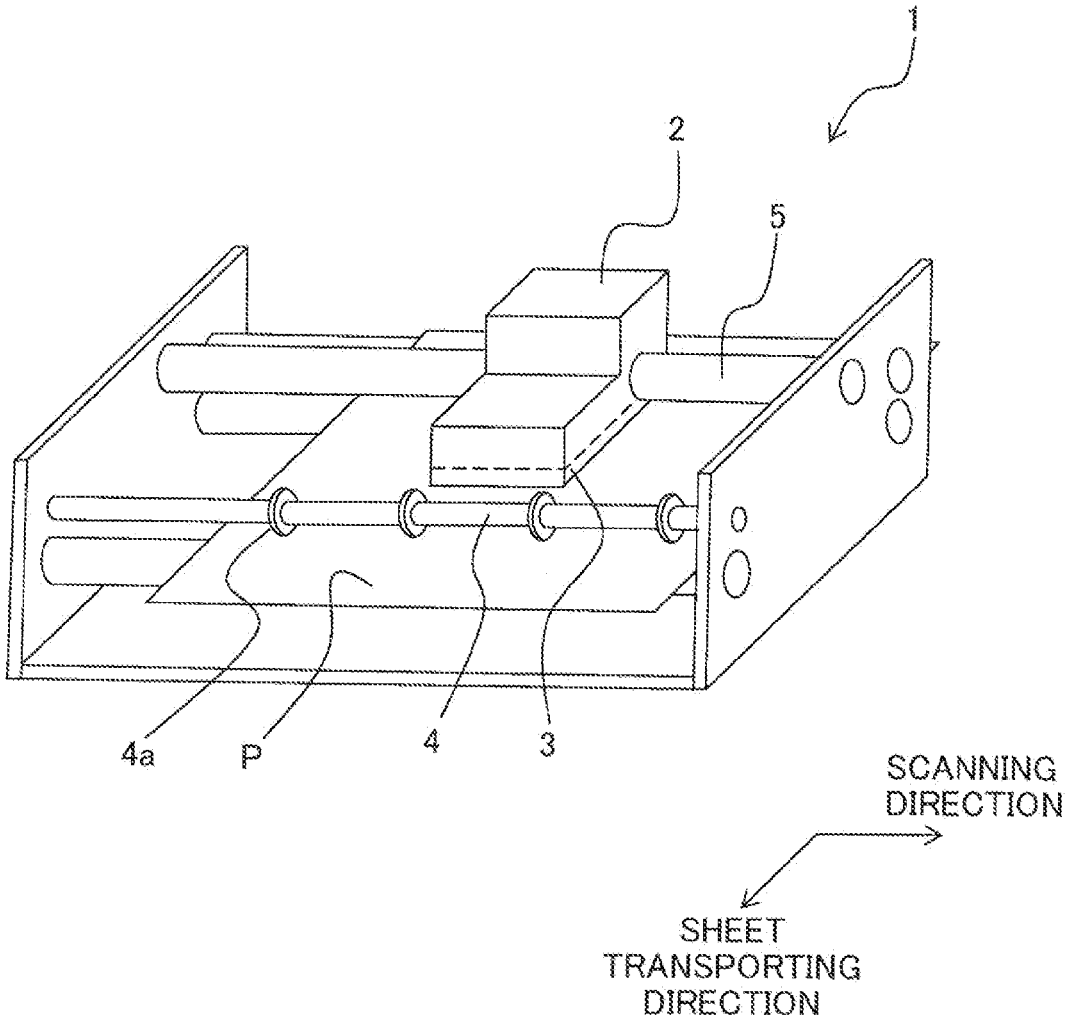
FIG. 1 is a schematic view of a construction of a printer 1 having an ink-jet recording head 3 which is an embodiment of the present teaching.

FIG. 1 is a schematic view showing the construction of a printer 1 having an ink-jet recording head 3 which is an embodiment of the present teaching. The printer 1 may be applied to a printer apparatus only having printing function, or may be applied to a printer unit included in a multi-function apparatus having a plurality of functions such as copying function, facsimile function, etc. As shown in FIG. 1, the printer 1 is provided with a carriage 2, an ink-jet recording head 3, a sheet transporting roller 4, a guide shaft 5, a platen (not shown), etc. which are arranged in an apparatus body (body) of the printer apparatus or multi-function apparatus. Note that in the following explanation, a direction in which the liquid is discharged from a nozzle is the downward direction and a direction opposite to the downward direction is the upward direction. In a case that direction(s) is defined in the drawing as necessary, an appropriate explanation therefor will be made.

The carriage 2 is provided to be movable along the guide shaft 5 which extend in the left/right direction (scanning direction) in FIG. 1; the carriage is constructed to be reciprocapable in the left/right direction (scanning direction) by an un-illustrated driving unit. A plurality of exchangeable ink cartridges (not shown) which supply a plurality of kinds of inks (for example, four color inks of black, yellow, cyan and magenta) respectively are stationarily disposed in the apparatus body; and the cartridges are connected, via ink tubes (not shown) respectively, to the ink-jet recording head 3 disposed below the carriage 2. Further, a sheet transport roller 4 and spurs 4*a* are arranged at a position below the carriage 2 and facing or opposite to the carriage 2. A recording sheet (recording paper) P is transported between the carriage 2, and the sheet transport roller 4 and the spurs 4*a* in the frontward direction in FIG. 1 (sheet transporting direction). The ink-jet recording head 3 is arranged at a position below or under the carriage 2, and has a plurality of nozzles which are formed on the lower surface of the ink-jet recording head 3 and which are exposed downwardly from the carriage 2.

Further, in the printer 1, recording is performed on the recording sheet P by discharging the ink, from the ink-jet recording head 3 reciprocating in the scanning direction together with the carriage 2, onto the recording sheet P which is transported by the sheet transporting roller 4 in the sheet transporting direction.

<Ink-Jet Recording Head>

Figure 2:
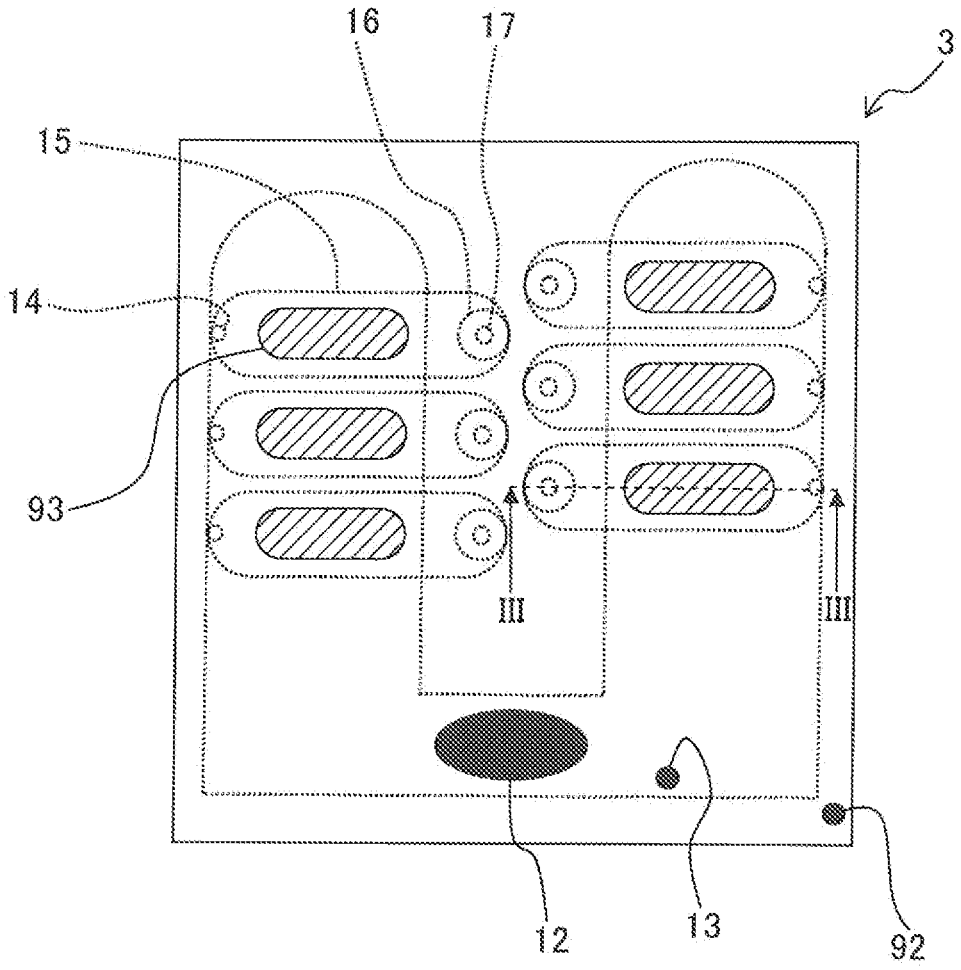
FIG. 2 is a partially enlarged view of the upper surface of the ink-jet recording read 3.
Figure 3:
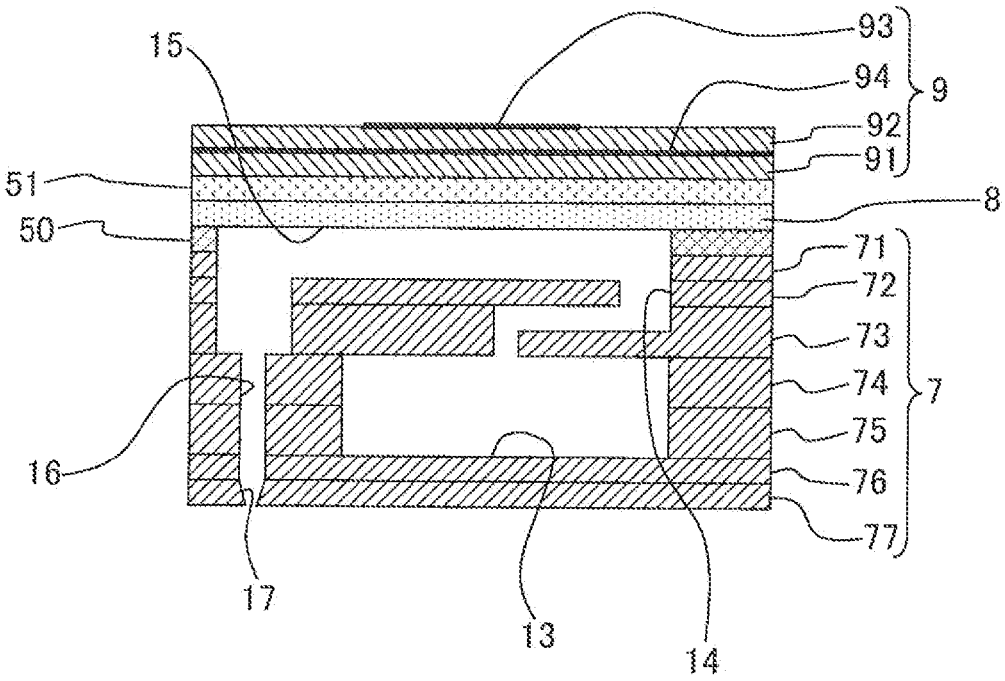
FIG. 3 is a sectional view taken along a line shown in FIG. 2.

An explanation will be given about the ink-jet recording head 3 with reference to FIGS. 2 and 3. The ink-jet recording head 3 is provided with a channel unit 7 in which a plurality of ink channels including a plurality of nozzles 17 and a plurality of pressure chambers 15 are formed; an intermediate member 8 which is arranged on the upper surface of the channel unit 7; and a piezoelectric actuator unit (piezoelectric actuator) 9 which is arranged on the upper surface of the intermediate member 8 (on the side opposite to or not facing the channel unit 7). The pressure chambers 15 are open (have openings) outwardly on one surface of the channel unit 7, and the intermediate member 8 is adhered to the one surface of the channel unit 7 so as to cover the openings of the pressure chambers 15. The intermediate member 8 is arranged between the channel unit 7 and the piezoelectric actuator 9 and is formed of a material through which the ink is not permeable (though which the ink cannot pass) so as to prevent the ink in the ink channel from reaching up to the piezoelectric actuator 9. The piezoelectric actuator 9 applies, to the ink filled in the pressure chambers 15, a pressure for discharging the ink from the nozzles 17. As will be described later, the channel unit 17 and the intermediate member 8 are adhered and joined with each other by a thermo-setting adhesive 50 which does not contain any curing agent, and the intermediate member 8 and the piezoelectric actuator 9 are adhered and joined with each other by an adhesive 51 which contains a curing agent and which is cured at room temperature.

<Channel Unit>

The channel unit 7 is constructed by stacking a plurality of plates 71 to 77 with each other, and the plates 71 to 77 have a substantially rectangular-shape and a plurality of through holes which are formed therein and which serve as the ink channel. The channel unit 7 (plates 71 to 77) is formed with a plurality of ink channels (a plurality of individual ink channels) including an ink supply port 12, a manifold channel 13 to which the ink is supplied from the ink supply port 12, aperture channels 14, pressure chambers 15, descender channels 16 and nozzles 17. Each of the ink channels extends from the ink supply port 12 and arrives at the manifold channel 13, extends from the outlet of the manifold channel 13 and arrives at one of the pressure chambers 15 via one of the aperture channels 14, and further extends from one of the pressure chambers 15 and arrives at one of the nozzles 17 via one of the descender channels 16.

Further, as will be described later on, when the piezoelectric actuator 9 applies the pressure to the ink in a certain pressure chamber 15 among the pressure chamber 15, the ink is discharged from a certain nozzle 17 among the nozzles 17 communicating with the certain pressure chamber 15. The plates 71 to 77 are made of a metallic material such as a stainless steel plate, a nickel alloy steel plate, etc. The thermal expansion coefficient (linear expansion coefficient) of the plates 71 to 77 is about $1.0\times10^{-5}$ to $1.8\times10^{-5}$/degrees Celsius.

<Intermediate Member>

The intermediate member 8 is made of a metallic material such as a stainless steel plate, a nickel alloy steel plate, etc., and is arranged in the channel unit 7 so as to cover the plurality of pressure chambers 15 of the channel unit 7. The intermediate member 8 has a thickness of about 5 μm to 20 μm. In this case, the thermal expansion coefficient (linear expansion coefficient) of the intermediate member 8 is similar to those of the plates 71 to 77. Note that it is not necessarily indispensable that the intermediate member 8 is formed of a metallic material, and a material through which the ink is not permeable, such as a ceramics, a resin, etc. is also applicable as the material for the intermediate member 8.

Note that as in the case of the embodiment wherein the plates 71 to 77 constructing the channel unit 7 and the intermediate member 8 are formed of a same material, the thermal expansion coefficient of the channel unit 7 is same as the thermal expansion coefficient of the intermediate member 8. Therefore, no compressive stress is applied to the channel unit 7 and the intermediate member 8 when the temperature returns to the room temperature after the adhesion performed at a high temperature (which will be described later on). Accordingly, it is possible to prevent the channel unit from deforming and to prevent the characteristic or property of the liquid channel, such as channel resistance, etc., from being changed.

<Adhesive>

A thermo-setting adhesive (thermo-curable adhesive) 50 is composed to contain an epoxy resin as a main agent thereof, is arranged between the channel unit 7 and the intermediate member 8, and adheres and joins the channel unit 7 and the intermediate member 8 with each other. Since the thermo-setting adhesive 50 contains the epoxy resin as the main agent, the thermo-setting adhesive 50 is cured when being heated and the temperature thereof is greater than a predetermined curing start temperature. Note that when curing the thermo-setting adhesive 50, any curing agent is not required, and thus no curing agent is added to the thermo-setting adhesive 50. Therefore, even when the ink and the thermo-setting adhesive 50 are brought into contact with each other, a component of the curing agent does not elute into the ink. Note that it is also allowable to use, as the thermo-setting adhesive 50, an adhesive containing phenol resin, urea resin, melamine resin, etc. as the main agent thereof.

The adhesive 51 is composed by adding a curing agent to the epoxy resin, is arranged between the intermediate member 8 and the piezoelectric actuator 9, and adheres and joins the intermediate member 8 and the piezoelectric actuator 9 with each other. Since the curing agent is added to the adhesive 51, the adhesive 51 is cured at a low temperature, as compared with an adhesive in which any curing agent is not added. Here, as the epoxy resin (main agent), it is possible to use bisphenol-A diglycidyl ether, epoxy novolac, cycloaliphatic epoxy (alicyclic epoxy), brominated epoxy, flexible epoxy, etc. As the curing agent, it is possible to use aromatic amine, aliphatic amine, acid anhydride, phenolic novolac, catalyst, polyamide, polysulphide, etc. Note that it is not necessarily indispensable that the adhesive 51 is composed of the adhesive in which the curing agent is added to the epoxy resin, and the adhesive 51 may be an agent containing another thermo-setting resin and an appropriate curing agent. Alternatively, it is also allowable to use, as the adhesive 51, an adhesive which starts to be cured at room temperature (room-temperature setting adhesive) such as a vinyl acetate-based adhesive, a urea-based adhesive, a polyurethane-based adhesive, a polyether acrylate-based adhesive, etc.

<Piezoelectric Actuator>

The piezoelectric actuator 9 is provided with a vibration plate 91, a piezoelectric layer 92, an individual electrode 93 and a common electrode 94.

The vibration plate 91 is made of a piezoelectric material of which main component is lead zirconate titanate (PZT) that is a mixed crystal of lead titanate and lead zirconate, and is arranged continuously on the upper surface of the intermediate member 8 so as to cover the plurality of pressure chambers 15.

The piezoelectric layer 92 is made of a piezoelectric material of which main component is lead zirconate titanate (PZT) that is a mixed crystal of lead titanate and lead zirconate, and is arranged continuously on the upper surface of the vibration plate 91 so as to cover the plurality of pressure chambers 15. Further, the piezoelectric layer 92 is previously polarized in the thickness direction thereof. Note that the thermal expansion coefficient (linear expansion coefficient) of the piezoelectric layer 92 (PZT) is about $0.2\times10^{-5}$ to $0.3\times10^{-5}$/degrees Celsius which is smaller than the thermal expansion coefficient of the plates 71 to 77 formed of the metallic material.

The individual electrode 93 is provided as a plurality of individual electrodes 93 which are printed and formed on the upper surface of the piezoelectric layer 92, and are each located at a position overlapping, in a plane view, with a substantially central portion of one of the pressure chambers 15. The individual electrodes 93 are electrically connected to a driver IC (not shown in the drawing) via an un-illustrated flexible printed wiring board (FPC), and the electric potential of the individual electrodes 93 are switched between ground electric potential and driving electric potential by the driver IC.

The common electrode 94 is printed and formed on the upper surface of the vibration plate 91, and is arranged to correspond to all the pressure chambers 15 of the channel unit 7. The common electrode 94 is electrically connected to the driver IC (not shown in the drawing) via the un-illustrated flexible printed wiring board (FPC), and the electric potential of the common electrode 94 is maintained at the ground electric potential by the driver IC.

<Operation of the Piezoelectric Actuator During the Ink Discharge>

Here, an explanation will be given about the operation (action) of the piezoelectric actuator 9 during the ink discharge. In a case of discharging (jetting) the ink from a certain nozzle 17 among the nozzles 17, a driving electric potential is applied from the driver IC to an individual electrode 93, among the individual electrodes 93, which corresponds to a pressure chamber 15 among the pressure chambers 15 communicating with the certain nozzle 17. Then, as the driving electric potential is applied to the individual electrode 93, an electric potential difference is generated between the individual electrode 93 to which the driving electric potential is applied and the common electrode 94 which is kept at the ground electric potential, and an electric field in a direction parallel to the thickness direction is generated in the piezoelectric layer 92 at a portion thereof sandwiched between the individual electrode 93 and the common electrode 94. Here, since the direction of the electric field is same as or parallel to a direction (polarization direction) in which the piezoelectric layer 92 is polarized, the piezoelectric layer 92 contracts in a horizontal direction orthogonal to the direction of the electric field (piezoelectric traverse effect). With this, a portion of the vibration plate 91 as a lower layer and facing the pressure chamber 15 is deformed to project toward the pressure chamber 15 (unimorph deformation). At this time, due to a decrease in a volume of the pressure chamber 15, the pressure of the ink inside the pressure chamber 15 is increased and the ink is jetted from the nozzle 17 communicating with the pressure chamber 15.

<Production Steps>

Next, an explanation will be given about steps for producing the ink-jet recording head 3 according to the present teaching, with reference to FIGS. 4A and 4B, FIGS. 5A, 5B and FIGS. 6A, 6B.

When producing the ink-jet recording head 3, the piezoelectric actuator 9, the intermediate member 8 and the channel unit 7 are produced individually (separately) from each other (piezoelectric actuator producing step (PA producing step S10); intermediate member producing step (IM producing step S20); channel unit producing step (CU producing step S30). Afterwards, the piezoelectric actuator 9, the intermediate member 8 and the channel unit 7 are joined to one another. A CU forming step S31 (to be described later on) and the PA producing step S20 and the IM producing step S20 as described above correspond to the step of preparing the channel unit, the piezoelectric element and the intermediate member of the present teaching.

In the PA producing step S10, the vibration plate 91, the piezoelectric layer 92, the individual electrodes 93 and the common electrode 94 are stacked on top of one another and joined with one another, while being positioned with respect to one another, so as to provide the positional relationship as described above, and then the vibration plate 91, the piezoelectric layer 92, the individual electrodes 93 and the common electrode 94 are joined to one another (PA joining step S11). Afterwards, the electric potential difference is provided between the individual electrodes 93 and the common electrode 94 to polarize portions (active portions), of the piezoelectric layer 92, each sandwiched between one of the individual electrodes and the common electrode 94 in the thickness direction of the active portions (Polarizing step S12).

In the CU producing step S30, the respective plates 71 to 77 constructing the channel unit 7 are processed to form the through holes in the plates, the through holes forming the ink channel such as the pressure chambers 15, the manifold channel 13, etc. (CU forming step S31). After that, the plates 71 to 77 are stacked and joined with one another while being positioned with respect to one another (CU joining step S32). Although any adhesive may be used to join the plates 71 to 77 with one another, it is preferable that the plates 71 to 7 are joined with the thermo-setting adhesive 50. As described above, any curing agent is not added to the thermo-setting adhesive 50 for the purpose of lowering the curing start temperature. Therefore, in a case that the thermo-setting adhesive 50 is used, even when the ink in the channel unit 7 and the thermo-setting adhesive 50 make contact with each other, it is possible to suppress a component of the curing agent from eluting into the ink. In the CU joining step S32 for joining the plates 71 to 77, at first, the thermo-setting adhesive 50 is coated on joining surfaces of plates (First coating step S33). Then, the plates are stacked on top of one another via the thermo-setting adhesive 50 (CU stacking step S34) and pressure is applied to the stacked plates while heating the plates at a predetermined temperature higher than the curing start temperature of the thermo-setting adhesive 50 (CU heating step S35). By doing so, since the thermo-setting adhesive 50 is cured, the plates are joined. After the plates have been joined, the application of heat and pressure is released, and the plates are cooled (CU cooling step S36). Here, the application of heat and pressure to the plates may be performed each time one plate among the plates is stacked. Alternatively, after stacking the plates at one time, the application of heat and pressure may be performed for the plates at the same time for the plurality of plates (for all the stacked plates). In the latter case, it is possible to reduce the number of times of the CU heating step S35, thereby making it possible to simplify the production steps.

The piezoelectric actuator 9, the intermediate member 8 and the channel unit 7 which are produced as described above are joined with one another to produce the ink-jet recording head 3 (Recording-head production step S40).

Figure 4A:
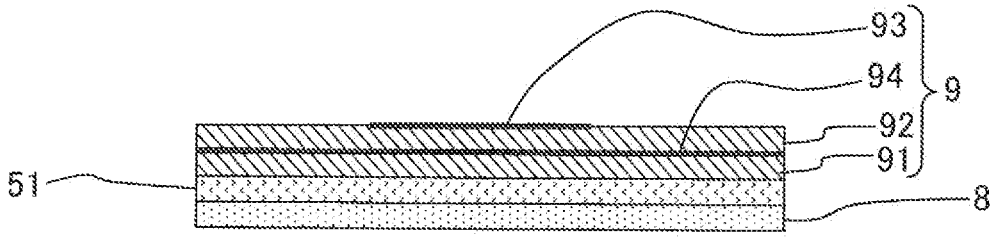
FIGS. 4A and 4B are schematic views showing production steps for producing the ink-jet recording head 3 of the present teaching.
Figure 4B:
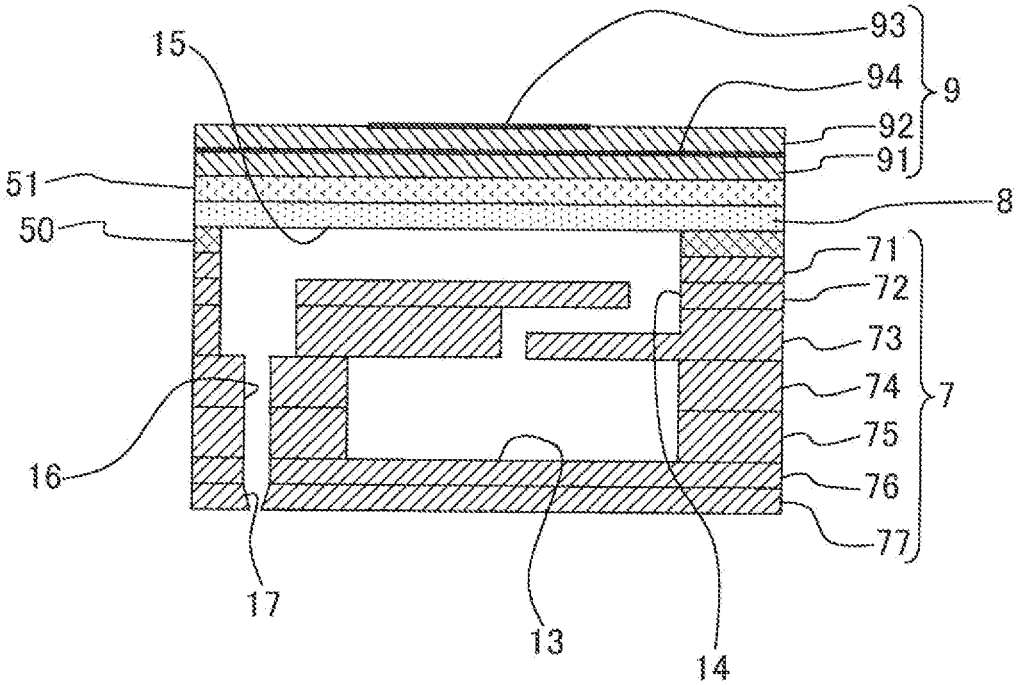

In the Recording-head production step S40, at first, as shown in FIG. 4A, the intermediate member 8 and the piezoelectric actuator 9 are joined (Intermediate member-Piezoelectric actuator joining step (I-P joining step) S41); next, as shown in FIG. 4B, the intermediate member 8 joined to the piezoelectric actuator 9 is joined to the channel unit 7 (Intermediate member-Channel unit joining (I-C joining step) S51). Note that in the present teaching, the I-P joining step S41 and the I-C joining step S51 correspond to the second adhering step and the first adhering step, respectively. Here, in the I-P joining step S41, at first, the adhesive 51 is coated on the intermediate member 8 at a joining position at which the intermediate member 8 is to be joined with the piezoelectric actuator 9 (second coating step S42). The adhesive 51 coated here is an adhesive obtained by adding a curing agent to a thermo-setting adhesive. Since the curing agent is added to the adhesive 51, the adhesive 51 is cured also at a low temperature, as compared with an adhesive in which any curing agent is not added. In the I-P joining step S41, further, the intermediate member 8 and the piezoelectric actuator 9 are stacked with the adhesive 51 intervened therebetween (via the adhesive 51) (I-P stacking step S43), and are pressurized while being heated at a predetermined temperature (a second heating temperature) (I-P heating step S44). By doing so, the adhesive 51 is cured and thus the intermediate member 8 and the piezoelectric actuator 9 are joined. However, in the I-P heating step S44, the temperature is maintained at a temperature which is low as compared with a case of performing the joining with the thermo-setting adhesive 50 (CU heating step S35). Here, the temperature for causing the adhesive 51 to be cured (curing start temperature) is a temperature which is low as compared with the curing start temperature of the thermo-setting adhesive 50. Accordingly, it is possible to make the difference between the thermal expansion of the intermediate member 8 and the thermal expansion of the piezoelectric actuator 9 to be smaller as compared with a case in which the heating is performed until arriving at the curing start temperature of the thermo-setting adhesive 50. Therefore, it is possible to reduce the compressive stress in the piezoelectric actuator 9 caused due to the difference between the thermal expansion of the piezoelectric actuator 9 and the thermal expansion of the intermediate member 8.

Here, it is preferable to use such an adhesive 51 that is cured at a temperature much lower than the curing start temperature of the thermo-setting adhesive 50. In particular, it is preferable to use such an adhesive 51 that is cured at the room temperature. Since in a case that the joining can be performed at the room temperature, the intermediate member 8 and the piezoelectric actuator 9 are not thermally expanded. Accordingly, it is possible to eliminate the compressive stress of the piezoelectric actuator 9 caused due to the difference between the thermal expansion of the piezoelectric actuator 9 and the thermal expansion of the intermediate member 8.

Further, in a case that the adhesive 51 is cured at the room temperature, there is required no special device or unit for the purpose of applying high temperature to cure the adhesive 51 when adhering the channel unit 7 and the piezoelectric actuator 9, thereby making it possible to reduce the cost for the adhesion.

In the I-C joining step S51 for joining the intermediate member 8 and the channel unit 7, at first, the thermo-setting adhesive 50 is coated at a joining position, on the channel unit 7, at which the channel unit 7 is to be joined to the intermediate member 8 (third coating step S52). Then, the channel unit 7 and the intermediate member 8 are stacked via the thermo-setting adhesive 50 (I-C stacking step S53), and are pressurized while being heated at a predetermined temperature (a first heating temperature) which is higher than the curing start temperature of the thermo-setting adhesive 50 (I-C heating step S54). By doing so, the thermo-setting adhesive 50 is cured, thus joining the channel unit 7 and the intermediate member 8 to each other. After the joining has been performed, the heating and the pressurization are released, and the joining portion between the channel unit 7 and the intermediate member 8 is cooled (I-C cooling step S55). As described above, since the thermo-setting adhesive 50 is composed of the epoxy resin as the main component thereof and is cured when being heated, there is no need to add any curing agent to the thermo-setting adhesive 50. Therefore, even if the ink and the thermo-setting adhesive 50 are brought into contact with each other, there is no such a component of the curing agent that elutes into the ink.

Figure 5A:
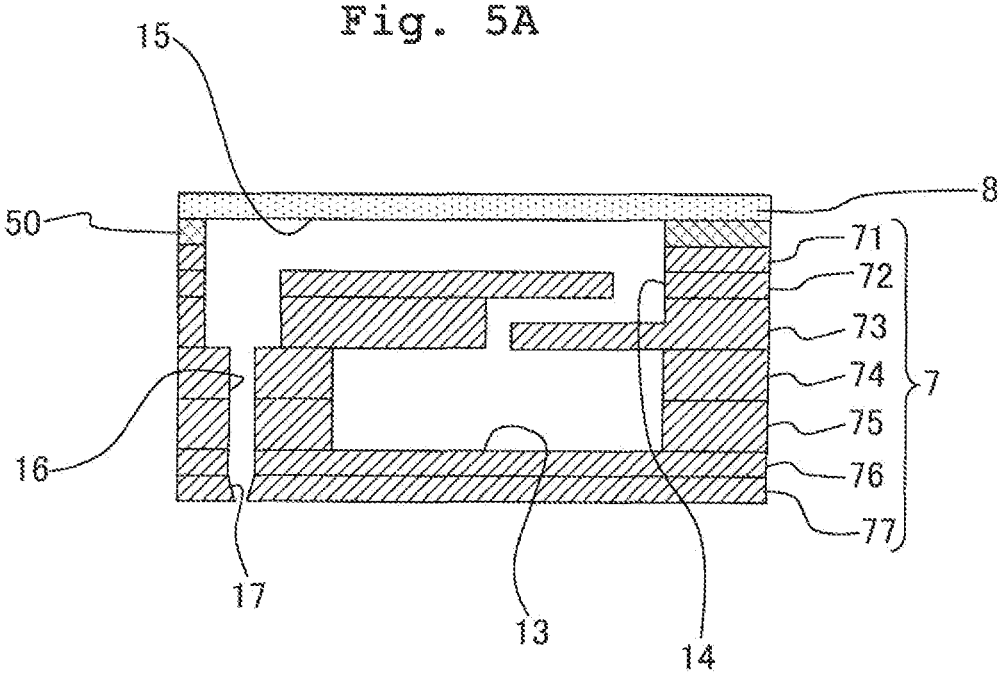
FIGS. 5A and 5B are schematic views showing another production steps for producing the ink-jet recording head 3 of the present teaching.
Figure 5B:
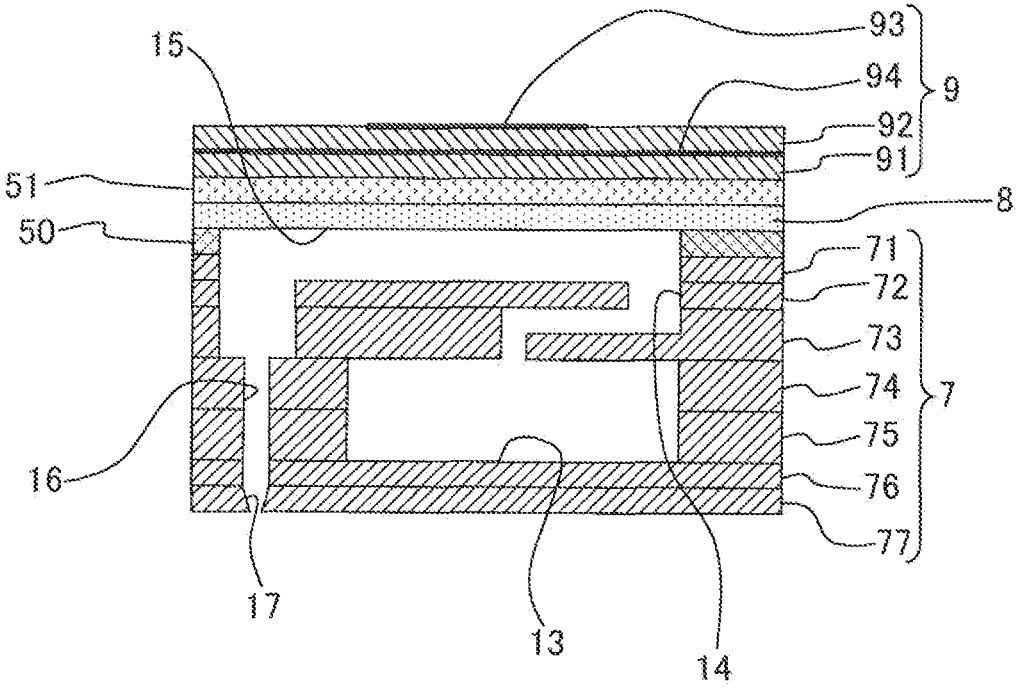
Figure 6A:
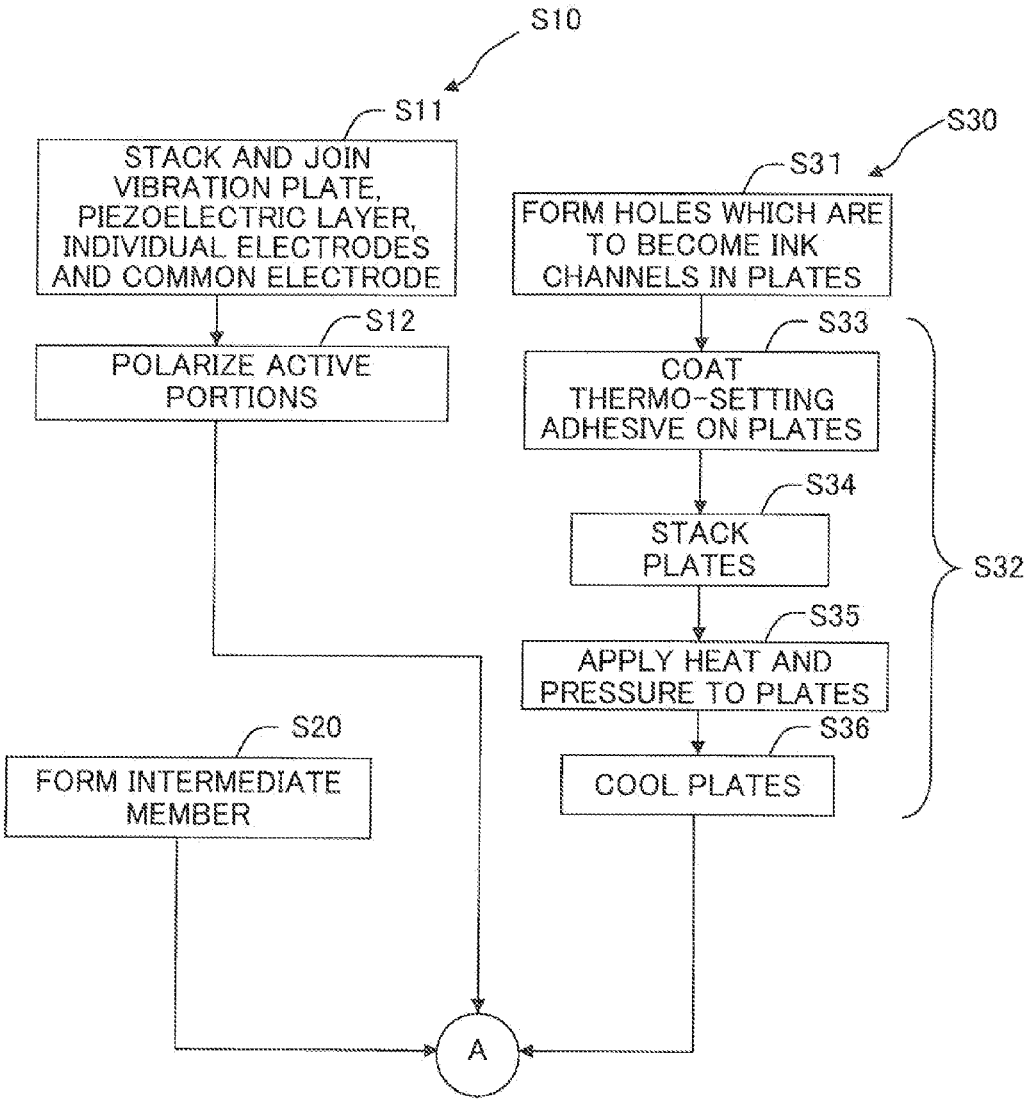
FIGS. 6A and 6B are flow charts showing a method for producing the ink-jet recording head 3 according to the present teaching.
Figure 6B:
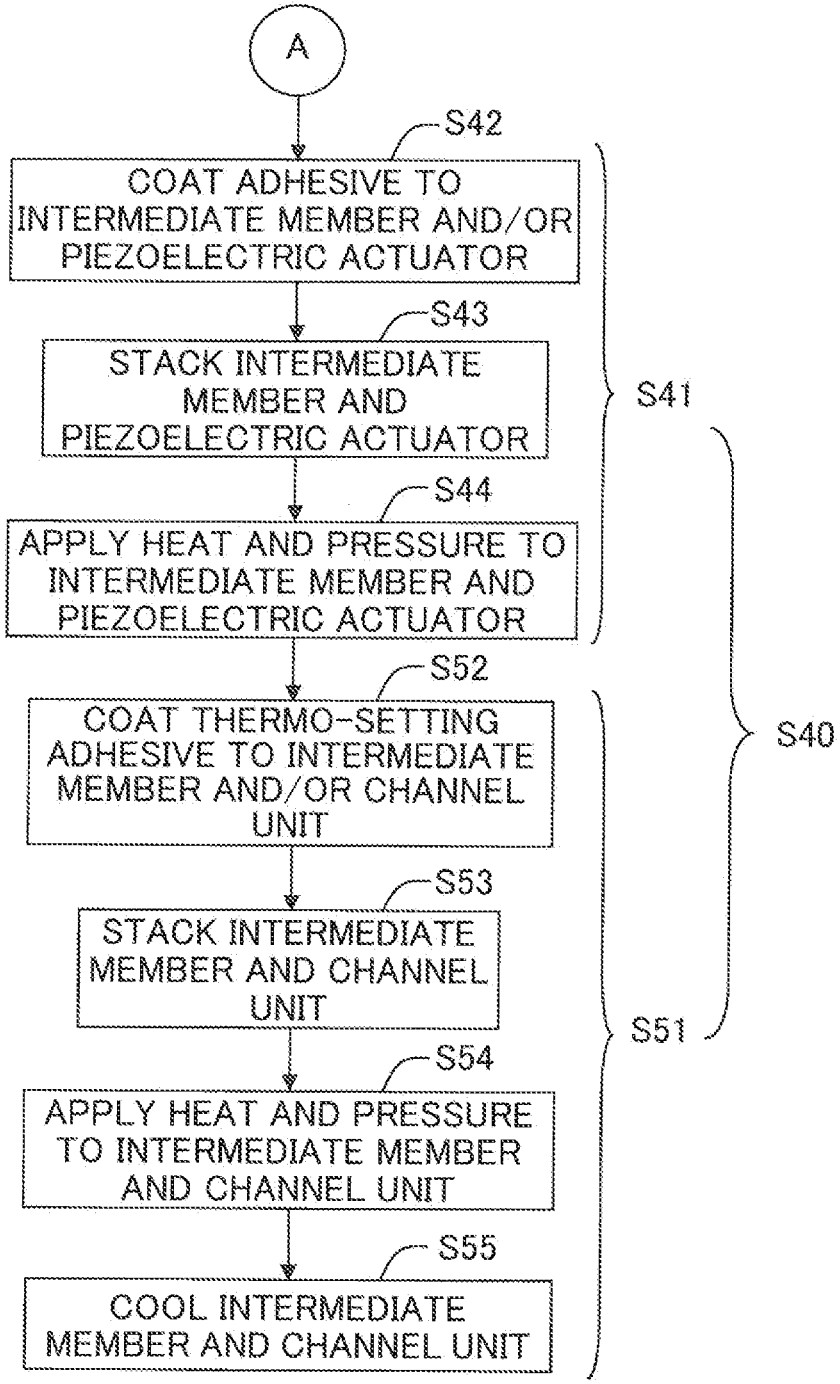

In the above-described embodiment, the intermediate member 8 and the channel unit 7 are joined after the intermediate member 8 and the piezoelectric actuator 9 have been joined. However, the present teaching is not limited to this, and it is possible to join the intermediate member 8 and the piezoelectric actuator 9 after joining the intermediate member 8 and the channel unit 7, as shown in FIGS. 5A and 5B. In such a case, when the channel unit 7 and the intermediate member 8 are to be joined at a high temperature, the piezoelectric actuator 9 has not been joined to the intermediate member 8 yet. Therefore, there is no fear that the piezoelectric actuator 9 is affected by the heat accompanying with the joining at a high temperature. Further, in a state that the heat is released and there is little thermal affect, the intermediate member 8 and the piezoelectric actuator 9 are joined to each other. In this case, the piezoelectric actuator 9 and the intermediate member 8 do not undergo any thermal expansion which would be otherwise caused by the thermal effect applied by the joining of the channel unit 7 and the intermediate member 8, thereby making it possible to make the compressive stress, which is caused due to the difference between the thermal expansion of the piezoelectric actuator 9 and the thermal expansion of the intermediate member 8, to be small. Further, the piezoelectric actuator 9 is not damaged by any thermal effect which would be otherwise applied to the piezoelectric actuator 9 by the joining of the channel unit 7 and the intermediate member 8. Therefore, it is possible to control the lowering of the piezoelectric characteristic. Furthermore, the I-C heating step S54 in the I-C joining step S51 for joining the intermediate member 8 and the channel unit 7 and the CU heating step S35 in the CU joining step S32 for joining the plates in the channel unit 7 can be performed at the same time. In this case, the application of heat and pressure can be performed at the same time, which in turn makes it possible to simplify the producing procedure.

Note that the intermediate member 8 is capable of functioning as a vibration plate (function to deform accompanying the deformation of the piezoelectric actuator so as to apply pressure to the ink in the pressure chamber 15), singly or in cooperation with the vibration plate 91. In the former case (the intermediate plate 8 singly functioning as the vibration plate), it is possible to omit the vibration plate 91; and in the latter case, it is possible to make the vibration plate 91 to be thin.

What is claimed is:

1. A liquid discharging head which discharges a liquid, comprising:

a channel unit in which a liquid channel and a pressure chamber are formed, the pressure chamber having an opening formed at one surface of the channel unit;

a piezoelectric element which is formed of a piezoelectric material, and which changes a volume of the pressure chamber;

an intermediate member which is adhered to the one surface of the channel unit to cover the opening of the pressure chamber, and which is arranged between the channel unit and the piezoelectric element to prevent the liquid in the pressure chamber and the piezoelectric element from making contact with each other;

a first adhesive layer which is composed of a first adhesive and which adheres the channel unit and the intermediate member, the first adhesive being a thermo-setting adhesive which starts to be cured at a first temperature; and a second adhesive layer which is composed of a second adhesive and which adheres the intermediate member and the piezoelectric element, the second adhesive starting to be cured at a second temperature lower than the first temperature.

2. The liquid discharging head according to claim 1;

wherein the channel unit has a plurality of substrates which are mutually stacked; and wherein the substrates are mutually adhered with the first adhesive.

3. The liquid discharging head according to claim 1;

wherein the channel unit is formed of a metallic material.

4. The liquid discharging head according to claim 1;
wherein the second adhesive starts to be cured at a room temperature.

5. The liquid discharging head according to claim 1;
wherein the intermediate member is a vibration plate which transmits deformation of the piezoelectric element to the pressure chamber.

6. The liquid discharging head according to claim 1;
wherein the channel unit and the intermediate member are formed of a same material.

7. The liquid discharging head according to claim 1;
wherein the first adhesive contains a first main agent which starts to be cured at the first temperature; and
wherein the first adhesive does not contain a first curing agent lowering a temperature at which the first main agent starts to be cured.

8. The liquid discharging head according to claim 1;
wherein the second adhesive contains a second main agent which starts to be cured at a temperature higher than the second temperature, and a second curing agent lowering a temperature, at which the second main agent starts to be cured, to be the second temperature.

9. The liquid discharging head according to claim 1;
wherein a thermal expansion coefficient of the piezoelectric material is smaller than a thermal expansion coefficient of a material forming the intermediate member.

10. The liquid discharging head according to claim 1;
wherein the second adhesive layer is arranged between the intermediate member and the piezoelectric element without gap.

11. The liquid discharging head according to claim 1;
wherein, after the first adhesive is cured to adhere the channel unit and the piezoelectric element at a temperature higher than the first temperature, and after the channel unit and the piezoelectric element are cooled down, the second adhesive is cured at a temperature lower than the first temperature.

12. The liquid discharging head according to claim 3;
wherein the channel unit and the intermediate member are formed of a same metallic material.

13. The liquid discharging head according to claim 7;
wherein the first adhesive contains, as the first main agent, one resin selected from a group consisting of epoxy resin, phenol resin, urea resin and melamine resin.

14. The liquid discharging head according to claim 8;
wherein the second adhesive contains the epoxy resin as the second main agent; and
wherein the second adhesive contains, as the second curing agent, one material selected from a group consisting of aromatic amine, aliphatic amine, acid anhydride, phenolic novolac, catalyst, polyamide, and polysulphide.

15. A method for producing a liquid discharging head which discharges a liquid, the method comprising:
a step of preparing a channel unit having:
a liquid channel formed in the channel unit and including a pressure chamber which has an opening at one surface of the channel unit;
a piezoelectric element which is formed of a piezoelectric material, and which changes a volume of the pressure chamber; and
an intermediate member which is to be adhered to the one surface of the channel unit to cover the opening of the pressure chamber, and which is to be arranged between the channel unit and the piezoelectric element to prevent the liquid in the pressure chamber and the piezoelectric element from making contact with each other;
a first adhering step of adhering the channel unit and the intermediate member with a first adhesive which is a thermo-setting adhesive; and
a second adhering step of adhering the intermediate member and the piezoelectric element with a second adhesive which is cured at a temperature lower than a temperature at which the first adhesive is cured.

16. The method for producing the liquid discharging head according to claim 15;
wherein the second adhering step is performed after the first adhering step has been performed.

17. The method for producing the liquid discharging head according to claim 13;
wherein the channel unit has a plurality of substrates which are mutually stacked; and
wherein the method further comprises a step of forming the channel unit by adhering, with the first adhesive, the substrates in a stacked state, before performing the first adhering step.

18. The method for producing the liquid discharging head according to claim 15;
wherein in the first adhering step, the first adhesive adhering the channel unit and the intermediate member is heated to a first heating temperature which is not less than a curing start temperature of the first adhesive; and
wherein in the second adhering step, the second adhesive adhering the intermediate member and the piezoelectric element is heated to a second heating temperature which is lower than the first heating temperature.

19. The method for producing the liquid discharging head according to claim 15;
wherein the second adhesive layer is arranged between the intermediate member and the piezoelectric element without gap.

20. The method for producing the liquid discharging head according to claim 15;
wherein the second adhering step is performed at a temperature lower than the first temperature, after the first adhering step has been performed, and after the channel unit and the intermediate member are cooled down.

21. The method for producing the liquid discharging head according to claim 17;
wherein the first adhering step and the step for forming the channel unit are performed at a same time.

* * * * *